US008733627B2

(12) United States Patent
Abedelal

(10) Patent No.: US 8,733,627 B2
(45) Date of Patent: May 27, 2014

(54) MONEY RECEPTACLES AND MECHANICAL COIN BANKS

(71) Applicant: Akram Abedelal, Lombard, IL (US)

(72) Inventor: Akram Abedelal, Lombard, IL (US)

(73) Assignee: Squirrel & Company, Lombard, IL (US)

( * ) Notice: Subject to any disclaimer, the term of this patent is extended or adjusted under 35 U.S.C. 154(b) by 0 days.

(21) Appl. No.: 13/780,654

(22) Filed: Feb. 28, 2013

(65) Prior Publication Data

US 2013/0248588 A1 Sep. 26, 2013

Related U.S. Application Data

(63) Continuation-in-part of application No. 29/416,536, filed on Mar. 23, 2012.

(60) Provisional application No. 61/614,634, filed on Mar. 23, 2012.

(51) Int. Cl.
*A47G 29/00* (2006.01)

(52) U.S. Cl.
USPC ..... 232/4 R; 446/8

(58) Field of Classification Search
USPC ..... 232/4 R, 1 D; 446/8–13; D99/34–38
See application file for complete search history.

(56) References Cited

U.S. PATENT DOCUMENTS 1,644,495 A * 10/1927 Shafer ..... 232/4 R
2,448,951 A 9/1948 Baum
D156,365 S * 12/1949 O'Malley ..... D99/38
D161,318 S * 12/1950 Cooper ..... D99/38
D170,574 S * 10/1953 Hickey ..... D99/36
4,079,540 A 3/1978 Boyett, III et al.
4,401,259 A 8/1983 Knutson
4,673,368 A 6/1987 Bush
5,482,487 A * 1/1996 Harris ..... 446/8
D368,790 S 4/1996 Sternberg
5,580,292 A 12/1996 Gaportsin
D385,598 S * 10/1997 Stephensen et al. ..... D21/654
5,716,211 A * 2/1998 Vetter ..... 434/107
6,186,852 B1 2/2001 Davis
D470,543 S 2/2003 Searls et al.
D503,505 S * 3/2005 Beacham ..... D99/38
D505,832 S * 6/2005 Rosow ..... D7/515
6,976,619 B2 * 12/2005 Beacham et al. ..... 232/4 R
D522,710 S * 6/2006 Beacham ..... D99/37
7,383,980 B1 * 6/2008 Beacham ..... 232/4 R
7,500,595 B1 * 3/2009 Beacham ..... 232/4 R

* cited by examiner

*Primary Examiner* — William Miller

(74) *Attorney, Agent, or Firm* — Nixon Peabody LLP

(57) ABSTRACT

Money receptacles and mechanical coin banks for storing coins, bills, and the like are presented herein. A money receptacle is disclosed which includes an elongated stand projecting from a support base, and a lever attached to the stand. A first storage receptacle is attached proximate a first end of the lever. The first storage receptacle has a first hollow compartment with an opening through which coins, bills, or both, can be passed into the first compartment. A second storage receptacle is attached proximate a second end of the lever opposite the first end. The second storage receptacle has a second hollow compartment with an opening through which coins, bills, or both, can be passed into the second compartment.

20 Claims, 2 Drawing Sheets

MONEY RECEPTACLES AND MECHANICAL COIN BANKS

CROSS-REFERENCE TO RELATED APPLICATIONS

This application is a continuation-in-part of U.S. patent application Ser. No. 29/416,536, filed Mar. 23, 2012, and this application further claims priority to and the benefits of U.S. Provisional Patent Application No. 61/614,634, filed on Mar. 23, 2012, the disclosures of each of these applications being hereby incorporated by reference herein in their entireties.

TECHNICAL FIELD

The present disclosure relates generally to storage containers for currency coins and bills, and more particularly to mechanical coin banks and similar money receptacles.

BACKGROUND

There are many different types of receptacles available for a person to store a mixture of currency coins and bills. One such receptacle is the toy coin bank or, as it is more commonly known, the penny or "piggy" bank. Originally intended as a pedagogical device to teach the rudiments of saving money to children, toy coin banks have become highly collectible. To collectors, there are two different types of toy coin banks—"still banks" and "mechanical banks," the main distinction being that a mechanical bank is mechanized to perform some kind of movement or other action, whereas still banks do not have moving parts.

Most typical coin banks include a single storage body within which can be stowed coins and paper money. Constructions of this type, however, inherently require the coin bank be emptied once the lone storage body becomes filled. In addition, the pedagogical nature of prior art coin banks is somewhat amorphous, often left to the user's imagination to ascertain the intended teachings of the coin bank. Considering most toy coin banks are intended for children, these educational aspects are oftentimes overlooked or missed altogether.

SUMMARY

According to one aspect of the present disclosure, a money receptacle is disclosed. The money receptacle includes an elongated stand that projects from a support base, and a lever attached to the stand. The money receptacle also includes a number of storage receptacles, including a first storage receptacle that is attached proximate a first end of the lever, and a second storage receptacle that is attached proximate a second end of the lever opposite the first end. The first storage receptacle has a first hollow compartment with an opening through which coins, bills, or both, can be passed into the first compartment. Similarly, the second storage receptacle has a second hollow compartment with an opening through which coins, bills, or both, can be passed into the second compartment.

According to another aspect of the present disclosure, a money receptacle for storing coins is disclosed. The money receptacle includes an elongated stand that projects from a support base, and a plurality of levers, including at least first and second levers that are independently movably attached at respective first ends to the stand. A first storage receptacle is attached proximate a second end of the first lever. The first storage receptacle has a first hollow compartment with an opening through which coins, bills, or both, can be passed into the first compartment. A second storage receptacle is attached proximate a second end of the second lever. The second storage receptacle has a second hollow compartment with an opening through which coins, bills, or both, can be passed into the second compartment.

According to other aspects of the present disclosure, a mechanical toy-sized coin bank is featured. The coin bank includes an elongated, generally cylindrical stand that projects upwardly from a flat support base. A first curvilinear lever is fastened to the stand to rotate about a first pivot axis that is centrally located with respect to the first lever. A second curvilinear lever is fastened to the stand to rotate about a second pivot axis, which is centrally located with respect to the second lever and spaced from the first pivot axis. A first pair of storage receptacles is selectively removably attached to respective ends of the first lever. Each of these storage receptacles has a respective hollow compartment with an opening through which coins, bills, or both, can be passed into the compartment. A second pair of storage receptacles is selectively removably attached to respective ends of the second lever. Each storage receptacle has a respective hollow compartment with an opening through which coins, bills, or both, can be passed into the respective compartment. Each pair of storage receptacles, when empty, is configured to counterbalance each other on their respective levers.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
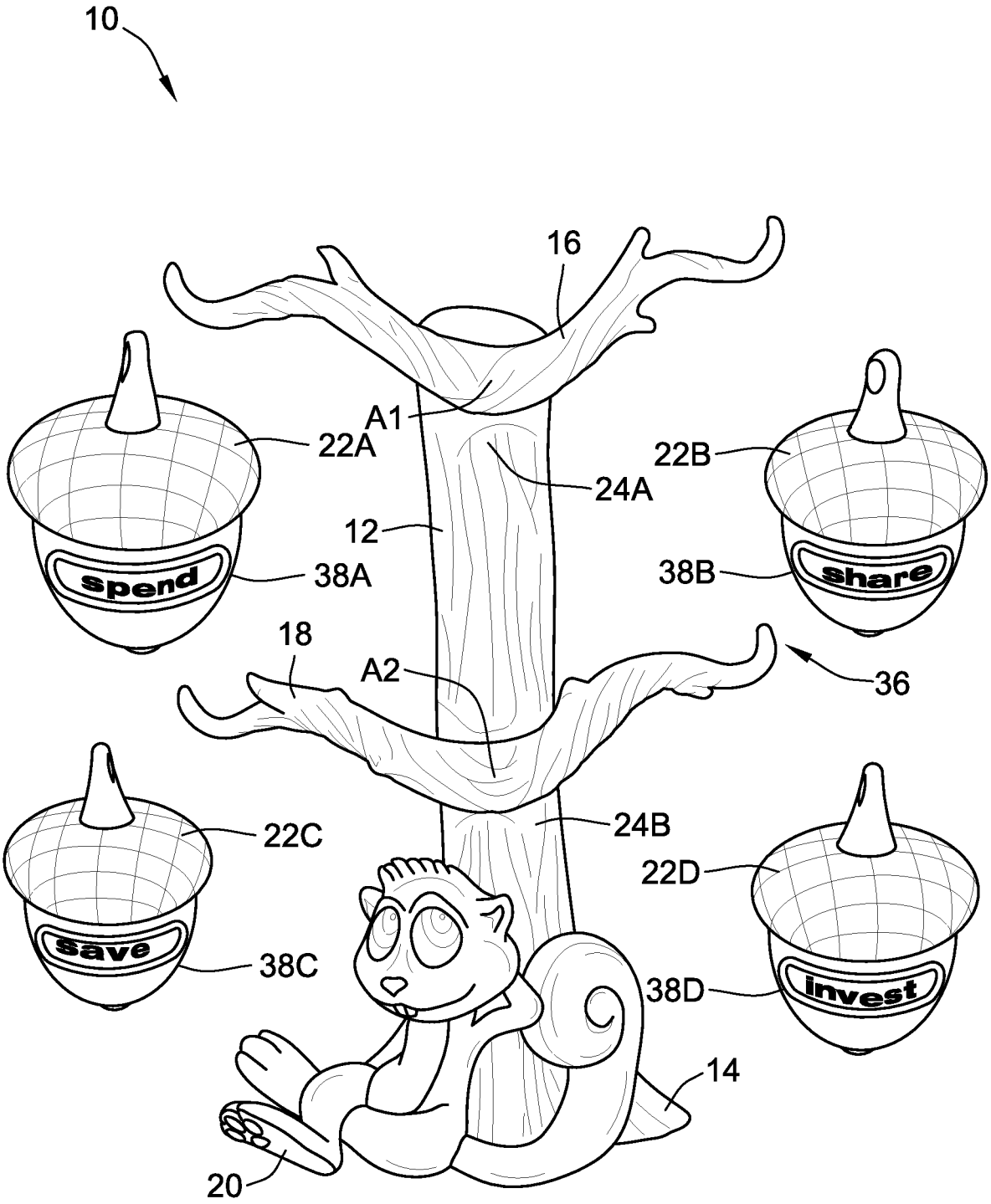
FIG. 1 is a front-view illustration of an exemplary coin bank according to aspects of the present disclosure, shown with four representative storage receptacles, all of which have been removed from the support stand.

While aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the described embodiments.

DETAILED DESCRIPTION

While this invention is susceptible of embodiment in many different forms, there is shown in the drawings and will herein be described in detail preferred and exemplary embodiments of the invention with the understanding that the present disclosure is to be considered as an exemplification of the principles of the invention and is not intended to limit the broad aspect of the invention to the embodiments illustrated. For purposes of the present detailed description, unless specifically disclaimed, the singular includes the plural, and vice versa; the words "and" and "or" shall be both conjunctive and disjunctive; the word "all" means "any and all"; the word "any" means "any and all"; and the word "including" means "including without limitation."

Figure 2:
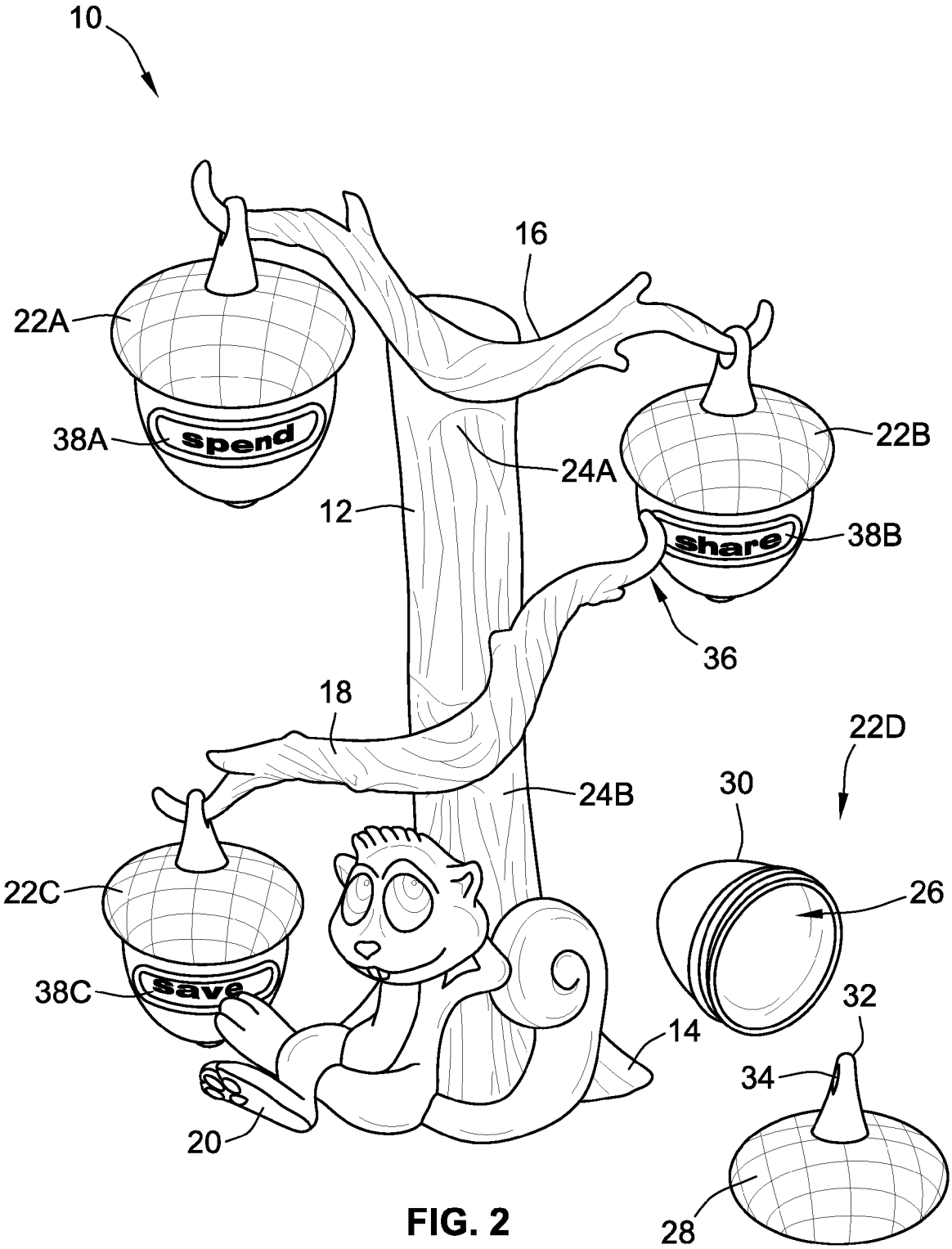
FIG. 2 is a perspective-view illustration of the coin bank of FIG. 1, shown with three of the storage receptacles removably mounted onto the pivotable levers of the support stand, and a fourth storage receptacle that has been removed from the support stand, opened and emptied.

Referring now to the drawings, wherein like reference numerals refer to like features throughout the several views, there is shown in FIG. 1 a representative money receptacle, designated generally at 10, in accordance with aspects of the present disclosure. The money receptacle 10 is intended for storing money, such as coins, bills, and the like, and thus may also be referred to herein as "coin bank." However, it is contemplated that in some aspects the money receptacle 10 can store other objects, such as buttons, tokens, gambling chips, and other similarly sized objects. The money receptacle 10 can also be associated with one or more themes that convey attributes of saving money. By way of non-limiting example, the money receptacle 10 shown in FIGS. 1 and 2 is associated with a squirrel-and-acorn theme where the money receptacle 10 is shaped like a tree with acorns on its limbs and a squirrel leaning against its base. Nevertheless, the money receptacle 10 can be associated with innumerable other themes within the scope of this disclosure. In addition, it should be understood that the drawings are not necessarily to scale and are provided purely for descriptive purposes. As such, the individual and relative dimensions of the drawings presented herein are not to be considered limiting.

The money receptacle 10 includes a stand 12 that projects upwardly from an integral support base 14. The stand 12 can have an elongated, generally cylindrical shape which may be closed at both longitudinal ends and contoured along its outer surface to resemble the trunk of a tree. The support base 14 portion of the money receptacle 10 is substantially flat and has a wider periphery than that of the stand 12 to provide lateral support to the money receptacle 10. In the illustrated embodiment, the stand 12 and base 14 are formed as an integral, monolithic structure that is fabricated from a rigid material, such as, but not limited to, high strength plastics (e.g., polyurethane, polyvinyl chloride, polyethylene, or any combination thereof), metallic materials (e.g., brushed steel or aluminum), composite materials, wood based materials, and other materials known to have a suitable strength for the intended use of the money receptacle 10.

One or more levers are attached to the stand 12 to support the storage receptacles which stow the coins and bills for the money receptacle 10. In the illustrated embodiment, for example, a first curvilinear lever 16 is fastened to the stand 12 to rotate about a first pivot axis A1 that is centrally located with respect to the first lever 16. A second curvilinear lever 18 is fastened to the stand 12 to rotate about a second pivot axis A2 that is centrally located with respect to the second lever 18 and vertically spaced from the first pivot axis A1. The first and second levers 16, 18 are designed, in at least some embodiments, to pivot independently of one another. The elongated stand 12 includes one or more stops 24A and 24B that are configured to limit the rotation of the levers 16, 18. Each of the levers 16, 18 is shaped like a pair of tree branches (or "boughs") that extend transversely across the stand 12. With the levers 16, 18 attached to the stand 12, the money receptacle 10 takes on the appearance of a tree with a squirrel 20 sitting against its base.

Optionally, the money receptacle 10 may include a plurality of levers, e.g., at least first and second levers, and in some embodiments four or more levers, each of which is independently movably attached at a respective first end thereof to the stand 12. In this optional arrangement, a storage receptacle is attached to, and thus supported on a second end of each of these independently movable levers. As a further option, the money receptacle 10 may include one or more rigidly attached levers that are configured not to move with respect to the stand 12.

As indicated above, the levers 16, 18 are configured to support thereon one or more storage receptacles for stowing coins, bills, and the like. The illustrated embodiment includes four receptacles: a first pair of storage receptacles—first and second storage receptacles 22A and 22B, respectively—that are supported by the first lever 16, and a second pair of storage Receptacles—third and fourth storage receptacles 22C and 22D, respectively—that are supported by the second lever 18. The first and second storage receptacles 22A and 22B are each removably attached to a respective opposing end of the first lever 16, whereas the third and fourth storage receptacles 22C and 22D are each removably attached to a respective opposing end of the second lever 18. In some embodiments, the storage receptacles 22C-D may be structurally identical, e.g., having the same shape and/or size. As such, all four of the storage receptacles 22A-D may be described collectively, for example, with reference to third or fourth storage receptacle 22C, 22D of FIG. 2. It is also contemplated that in certain embodiments, storage receptacle pairs may be similarly shaped or sized, or be of approximately the same weight with a different shape or size.

With reference to FIG. 2, each of the storage receptacles 22C and 22D has a respective hollow compartment, designated generally as 26, with an opening 28 through which coins, bills, or both, can be passed into the compartment 26. The fourth storage receptacle 22D is shown in FIG. 2 after being detached from the second lever 18 and opened to show the inside of the compartment 26. The fourth storage receptacle 22D includes a cap 28 that is removably attached (e.g., via internal threading, snap fit, magnetic bond, latch) to a cup 30. The cap 28 and cup 30, when attached together, collectively define the hollow compartment 26. With this arrangement, coins and bills stored in one receptacle are isolated from, and thus cannot be accidentally intermingled with coins and bills stored in another receptacle.

In the illustrated embodiment, each of the storage receptacles 22A-D is selectively removable from the levers 16, 18. With reference again to the fourth storage receptacle 22D shown in FIG. 2, a stem 32 projects upwardly from the cap 28. A slot 34, which passes through an upper portion of the stem 32, is configured to receive therethrough a hook portion 36 of the lever 18. The stem 32 and the lever 18 may also engage, removably or permanently, via any known means other than hook 36 and slot 34. The stem 32 and the lever 18 may couple in a manner that allows the stem 32 to freely rotate around the lever 18. The stem 32 may also be coupled to the lever 18 via a latch, clamp, or any other acceptable method or device, such that the storage receptacle 22D is selectively removable from the lever 18. Once the hook portion 36 is properly inserted into the slot 34, the storage receptacle 22D is pivotally attached to, and supported by the lever 18. If the user wishes to remove the storage receptacle 22D, the stem 32 need only be slid along the lever 18 away from the stand 12 until the hook portion 36 disengages the slot 34. As seen in FIG. 2, the first pair of storage receptacles 22A, 22B, when empty, counterbalances each other on the first lever 16. The same can be said for the second pair of storage receptacles 22C, 22D.

Each storage receptacle 22A-22D bears on an outside surface thereof indicia of a respective characteristic related to saving money. By way of non-limiting example, the first storage receptacle 22A has a first SPEND indicia 38A printed on its cup, while the second storage receptacle 22B bears a second SHARE indicia 38B, which is distinct from the first indicia 38A. In this regard, the third storage receptacle 22C has a third SAVE indicia 38C printed on its cup, while the fourth storage receptacle 22D bears a fourth INVEST indicia 38D, the third and fourth indicia 33C and 33D being distinct from each other and the indicia 38A, 38B on the first and second storage receptacles 22A, 22B.

The individual storage containers are designed to teach the components to effective use of money by allowing the user to store money away to SPEND, SHARE, SAVE, or INVEST. The spending component is money for the user to consume for one's own needs. This is money that children may use to buy toys, clothes, ice cream, etc. The sharing component, on the other hand, is money for the user to contribute to others, such as for charity and other altruistic purposes. By way of contrast, the saving component is money to be set aside for later, e.g., to save up for a particular goal or in case of a future emergency. Lastly, the investing component is money for the user to speculate or venture with, for example, to seek returns on interest, dividends, etc. For children, the individual containers teach that money has many potential applications and, thus, is not just for spending. In addition, the counterbalancing of the containers is a visual aid which teaches children that there should be balance and control in the manner in which they spend money.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A money receptacle comprising:

an elongated stand projecting from a support base;

a lever attached to the stand;

a first storage receptacle attached proximate a first end of the lever, the first storage receptacle having a first hollow compartment with an opening through which at least one of coins and bills can be passed into the first compartment; and a second storage receptacle attached proximate a second end of the lever opposite the first end, the second storage receptacle having a second hollow compartment with an opening through which at least one of coins and bills can be passed into the second compartment, wherein the first and second storage receptacles, when empty, are configured to counterbalance each other on the lever.

2. The money receptacle of claim 1, wherein the lever is pivotally attached to the stand to rotate about a pivot axis.

3. The money receptacle of claim 2, wherein the pivot axis is centrally located with respect to the lever.

4. The money receptacle of claim 1, wherein the first and second storage receptacles are selectively removable from the lever.

5. The money receptacle of claim 1, wherein the first and second storage receptacles are substantially identical in shape, size, or both.

6. The money receptacle of claim 1, wherein the first and second storage receptacles each includes a respective cap removably attached to a respective cup, the cap and cup collectively defining the respective hollow compartment.

7. The money receptacle of claim 1, wherein the first storage receptacle bears on an outside surface thereof indicia of a first characteristic, and the second storage receptacle bears on an outside surface thereof indicia of a second characteristic distinct from the first characteristic.

8. The money receptacle of claim 1, wherein the lever has an elongated curvilinear body.

9. The money receptacle of claim 1, wherein coins and bills stowed in the first storage receptacle are isolated from coins and bills stowed in the second storage receptacle.

10. The money receptacle of claim 1, wherein the lever is rotatably attached to the elongated stand, and the elongated stand includes one or more stops configured to limit rotation of the lever.

11. A money receptacle comprising:

an elongated stand projecting from a support base;

a lever attached to the stand;

a first storage receptacle attached proximate a first end of the lever, the first storage receptacle having a first hollow compartment with an opening through which at least one of coins and bills can be passed into the first compartment; and a second storage receptacle attached proximate a second end of the lever opposite the first end, the second storage receptacle having a second hollow compartment with an opening through which at least one of coins and bills can be passed into the second compartment, wherein the first and second storage receptacles are pivotally attached to the lever.

12. A money receptacle comprising:

an elongated stand projecting from a support base;

a lever rotatably attached to the stand;

a first storage receptacle attached proximate a first end of the lever, the first storage receptacle having a first hollow compartment with an opening through which at least one of coins and bills can be passed into the first compartment; and a second storage receptacle attached proximate a second end of the lever opposite the first end, the second storage receptacle having a second hollow compartment with an opening through which at least one of coins and bills can be passed into the second compartment, wherein the elongated stand includes one or more stops configured to limit rotation of the lever.

13. The money receptacle of claim 12, wherein the lever has an elongated curvilinear body.

14. The money receptacle of claim 12, wherein the first and second storage receptacles are substantially identical in shape, size, or both.

15. A money receptacle comprising:

an elongated stand projecting from a support base;

a lever attached to the stand;

a first storage receptacle attached proximate a first end of the lever, the first storage receptacle having a first hollow compartment with an opening through which at least one of coins and bills can be passed into the first compartment;

a second storage receptacle attached proximate a second end of the lever opposite the first end, the second storage receptacle having a second hollow compartment with an opening through which at least one of coins and bills can be passed into the second compartment;

a second lever attached to the stand;

a third storage receptacle attached proximate a first end of the second lever, the third storage receptacle having a third hollow compartment with an opening through which at least one of coins and bills can be passed into the first compartment; and a fourth storage receptacle attached proximate a second end of the second lever opposite the first end, the fourth storage receptacle having a fourth hollow compartment with an opening through which at least one of coins and bills can be passed into the second compartment, wherein the second lever is pivotally attached to the stand to rotate about a pivot axis.

16. The money receptacle of claim 15, wherein the pivot axis is centrally located with respect to the second lever and spaced from the first lever.

17. A money receptacle for storing coins, the money receptacle comprising:

an elongated stand projecting from a support base;

a plurality of levers including at least first and second levers independently movably attached to the stand;

a first storage receptacle attached proximate a first end of the first lever, the first storage receptacle having a first hollow compartment with an opening through which at least one of coins and bills can be passed into the first compartment; and a second storage receptacle attached proximate a first end of the second lever, the second storage receptacle having a second hollow compartment with an opening through which at least one of coins and bills can be passed into the second compartment.

18. The money receptacle of claim 17, wherein the first end of the first lever and the first end of the second lever are on opposite sides of the elongated stand.

19. The money receptacle of claim 17, further comprising at least one additional lever rigidly attached to the stand and supporting thereon at least one storage receptacle.

20. A mechanical toy-sized coin bank comprising:

an elongated generally cylindrical stand projecting from a flat support base;

a first curvilinear lever fastened to the stand to rotate about a first pivot axis centrally located with respect to the first lever;

a second curvilinear lever fastened to the stand to rotate about a second pivot axis centrally located with respect to the second lever and spaced from the first pivot axis;

a first pair of storage receptacles each being selectively removably attached to a respective end of the first lever and each having a respective hollow compartment with an opening through which coins, bills, or both, can be passed into the respective compartment; and a second pair of storage receptacles each being selectively removably attached to a respective end of the second lever and each having a respective hollow compartment with an opening through which coins, bills, or both, can be passed into the respective compartment, wherein the pairs of storage receptacles, when empty, are configured to counterbalance each other on their respective levers.

* * * * *